US006993892B2

(12) United States Patent
St. Louis

(10) Patent No.: US 6,993,892 B2
(45) Date of Patent: Feb. 7, 2006

(54) TAIL SET CRUPPER

(76) Inventor: Donna J. St. Louis, 9892 Old Homestead Rd., Pefferlaw (CA) L0E 1N0

( * ) Notice: Subject to any disclaimer, the term of this patent is extended or adjusted under 35 U.S.C. 154(b) by 1 day.

(21) Appl. No.: 10/778,386

(22) Filed: Feb. 17, 2004

(65) Prior Publication Data

US 2005/0178096 A1 Aug. 18, 2005

(51) Int. Cl.
*B68B 3/16* (2006.01)

(52) U.S. Cl. ..... 54/22; 54/78

(58) Field of Classification Search ..... 54/22, 54/78

See application file for complete search history.

(56) References Cited

U.S. PATENT DOCUMENTS

| | | | | |
|---|---|---|---|---|
| 195,029 | A | 9/1877 | Lindsay | |
| 822,788 | A | 6/1906 | Tuthill et al. | |
| 1,991,299 | A * | 2/1935 | Swaggerty | 54/22 |
| 2,136,032 | A | 11/1938 | Vanorio, Jr. | |
| 2,508,117 | A | 5/1950 | Lavery, Sr. | |
| 3,534,527 | A * | 10/1970 | Miller | 54/22 |
| 4,004,403 | A | 1/1977 | Henry, II | |
| 4,033,097 | A | 7/1977 | Petit | |
| 4,141,197 | A | 2/1979 | Nichols | |
| 4,217,575 | A | 8/1980 | Lorette | |
| 4,414,790 | A | 11/1983 | Mitchell | |
| 4,543,772 | A | 10/1985 | Mitchell | |
| 4,850,181 | A | 7/1989 | Pirotta | |
| D320,679 | S | 10/1991 | Edwards | |
| 5,076,041 | A | 12/1991 | Proust | |
| 5,177,940 | A | 1/1993 | Paul | |
| 5,274,986 | A | 1/1994 | Gonzales | |
| 5,410,863 | A | 5/1995 | Mouzon | |
| 5,901,532 | A | 5/1999 | Bopp | |
| 6,055,939 | A | 5/2000 | Stellies | |
| 6,085,499 | A | 7/2000 | Mead-Lewis | |
| 6,367,233 | B1 | 4/2002 | Mead-Lewis | |
| 6,408,603 | B1 | 6/2002 | Babuik | |
| 2002/0134319 | A1 | 9/2002 | Frink | |
| 2003/0041858 | A1 | 3/2003 | Spencer | |

* cited by examiner

*Primary Examiner*—Robert P. Swiatek
(74) *Attorney, Agent, or Firm*—Kenneth L. Bousfield; McCarthy Tetrault LLP

(57) ABSTRACT

A tailset crupper for an animal, such as a horse, may be made from a solid casting without lightening features, such as to produce a heavier, less easily dislodged object, such as may have a lower center of gravity, and a center of gravity located closer to the surface of the animal. The tendency to resist dislodgement may be enhanced by employing a higher aspect ratio of lobe width, or lobe span to trough size than might otherwise be used. The tendency to resist dislodgement may also be enhanced by employing a wedge, or spoon, that may tend to protrude inwardly of the surface of curvature of the crupper.

18 Claims, 19 Drawing Sheets

TAIL SET CRUPPER

FIELD OF THE INVENTION

This invention relates to the field of tail set cruppers.

BACKGROUND OF THE INVENTION

A tail set crupper is a portion of a harness for an animal, such as a horse, that is used to encourage the tail to be maintained in an arched shape. It may be worn by the animal for extended periods of time. After a period of use, the crupper may tend to cause the tail to be straightened relative to the direction of the spine of the animal, and also to extend on a relatively upstanding, arcuate shape, such that the tail may take on the desired "set", hence the "tail set" crupper. A horse, or other animal, may find the crupper uncomfortable. Consequently, the horse may make repeated efforts to dislodge the crupper. In the view of the present inventor, horses often are, or become, quite adept at dislodging the crupper. It might therefore be advantageous to have a crupper that might tend either to be more comfortable, or less easily dislodged, or both.

SUMMARY OF THE INVENTION

In an aspect of the invention there is a crupper. There is a base portion and a trough portion. The base portion has a first surface for placement next to the hindquarters of an animal. A trough portion is joined to the base portion. The trough portion, in use, extends outwardly away from the animal. The trough portion includes a spoon. The spoon extends inwardly proud of the first surface of the crupper a wedge distance. The trough has a width abreast of the first surface. The edge distance has a magnitude in the range of 20 to 50% of the width of the trough.

In an additional feature of that aspect of the invention, the crupper has a center of gravity. The first surface is formed on a compound curve, and a normal from the curve to the center of gravity has a length of less than 1½ inches. In yet another additional feature the crupper has a weight of at least 3 lbs., and a center of gravity located at least as close as 2 inches from the surface. In still another additional feature the crupper has a weight of at least 4 lbs.

In another additional feature the crupper has a center of gravity. The first surface is formed on a compound curve. The spoon has an arcuate portion extending inwardly of the surface. The arcuate portion has an apex. A first normal constructed from the compound curve to the apex intersects the compound curve at a first location. A second normal constructed from the compound curve to the center of gravity intersects the compound curve at a second location. The first location is separated from the second location by a distance of less than 1 inch.

In still yet another additional feature the base of the crupper includes first and second wing portions bracketing the trough. The trough has a cross-sectional area defined abreast of the wing portions. Each of the first and second wing portions has a surface area for placement facing the animal, and each of the surface areas of the wing portions are at least as great as the cross-sectional area of the trough. In a further feature the base of the crupper includes first and second wing portions bracketing the trough. The trough has a span width abreast of the wing portions, and the wings portions have an overall span that is greater than 200% of the span width of the trough abreast of the wing portions. In yet a further feature the base of the crupper includes first and second wing portions bracketing the trough, and a center of gravity. The wing portions each have a chord extending from a lowermost extremity to an uppermost extremity. The wing portions have an overall greatest span lying in a first plane perpendicular to the chord. The first plane meets the chord at a first altitude. A second plane extending through the center of gravity perpendicular to the chord intersects the chord at a second altitude. The first altitude and the second altitude differ by an amount less than one inch. In still a further feature the amount is less than 10% of the chord length. In another feature the amount is less than ¼".

In still another feature the base of the crupper includes first and second wing portions bracketing the trough. Each of the first and second wing portions has a surface area for placement facing the animal, and each of the surface areas of the wing portions have a lobate portion on which an ellipse of maximum area is defined. The ellipse has an area of at least 7½ sq. in.

In yet another feature a vertical-longitudinal plane bisects the trough. The ellipse has a splay angle from vertical. The ellipse has a major axis extending upwardly and outwardly relative to the vertical-longitudinal plane. In another additional feature the trough has a trough bottom and a center of gravity. The trough bottom has a generally upwardly facing trough bottom surface. The trough has a trough depth. The center of gravity is located a normal distance from the trough bottom surface. The normal distance is less than one half of the trough depth.

In still another feature the base of the crupper has a lower portion and an upper portion, and the lower portion has a greater through thickness than the upper portion. In yet another feature the base portion of the crupper tapers smoothly in thickness from the through thickness at the lower portion to the through thickness of the upper portion. In still yet another feature the through thickness of the lower portion exceeds ½ inch. In a further feature the base portion has an overall surface area for placement facing the hindquarters of the animal, and that overall surface area exceeds 20 sq. in. In still a further feature the inwardly protruding portion of the spoon has a smooth arcuate edge free of crenellations.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF THE INVENTION

Figure 1:
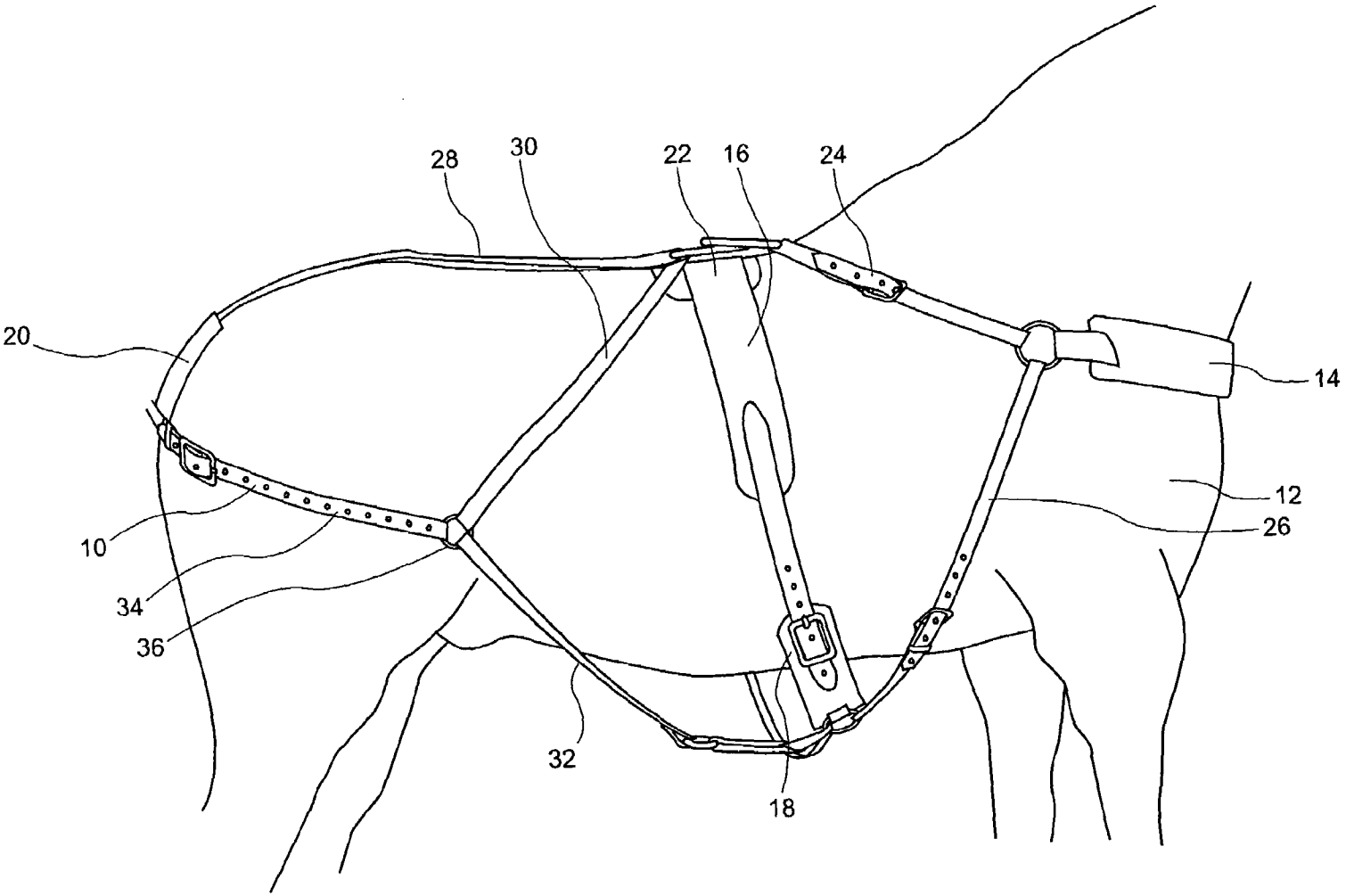
FIG. 1 shows the general arrangement of a harness on a horse, in side view, including the general positioning of a crupper according to the principles of the present invention.
Figure 2B:
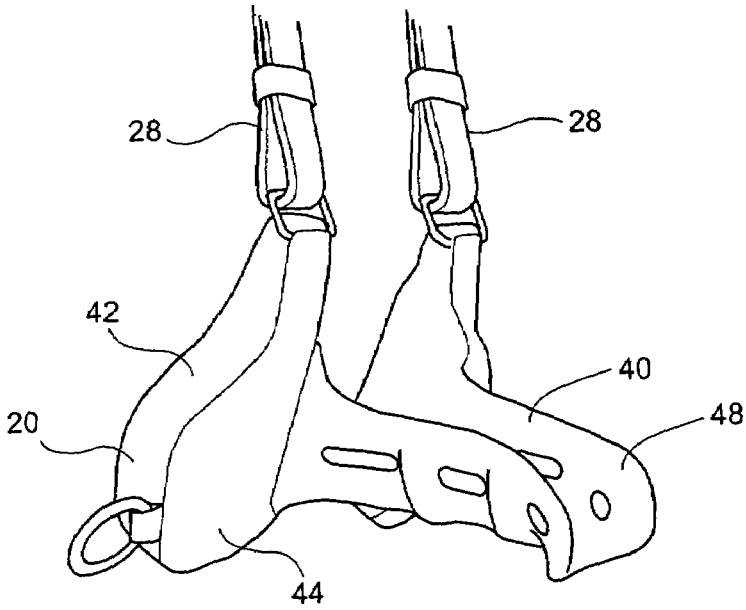
FIG. 2*b* shows the crupper of FIG. 2*a*, with padding from a rearward perspective view showing the leader pad cover.
Figure 2A:
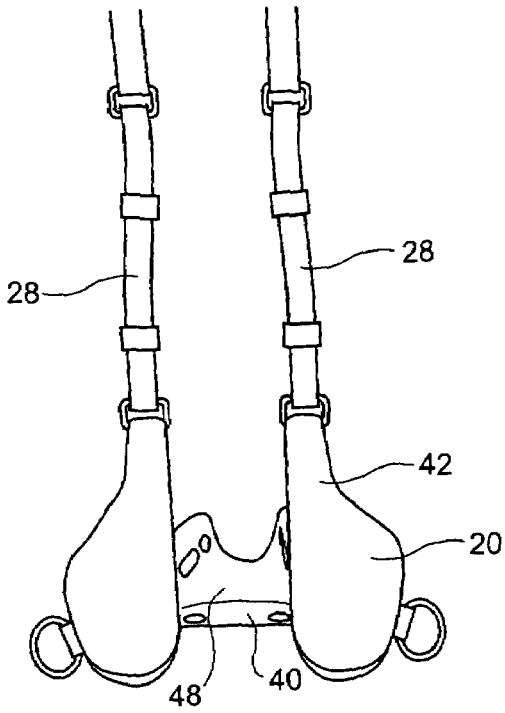
FIG. 2*a* shows a front view of a crupper, with padding, ready for mounting on the horse of FIG. 1.
Figure 3A:
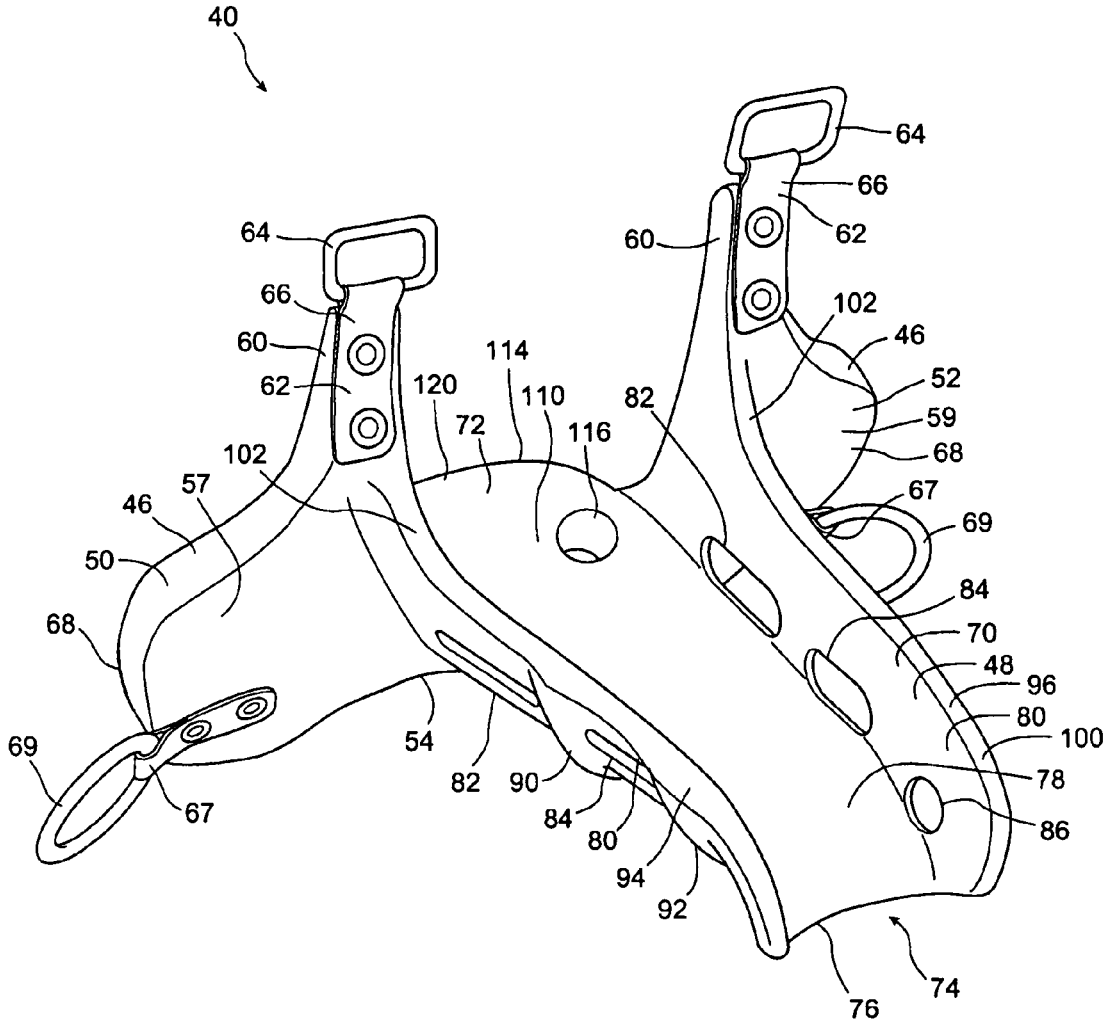
FIG. 3*a* shows a perspective view of the crupper of FIG. 2*a*, without padding or leather cover taken from above, behind, and to the left.
Figure 3B:
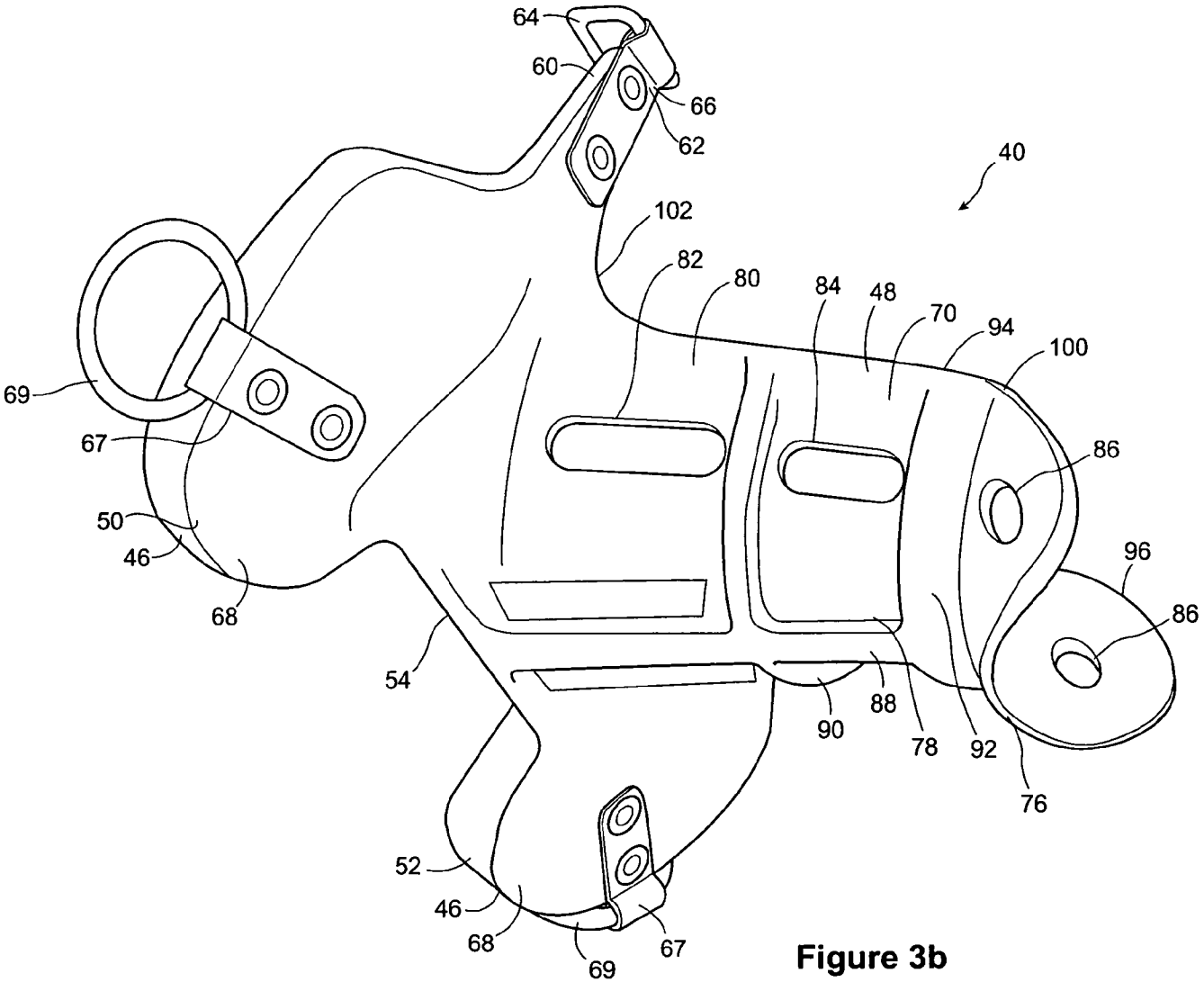
FIG. 3*b* shows a perspective view of the crupper of FIG. 3*a* from below, behind, and to the left.
Figure 3C:
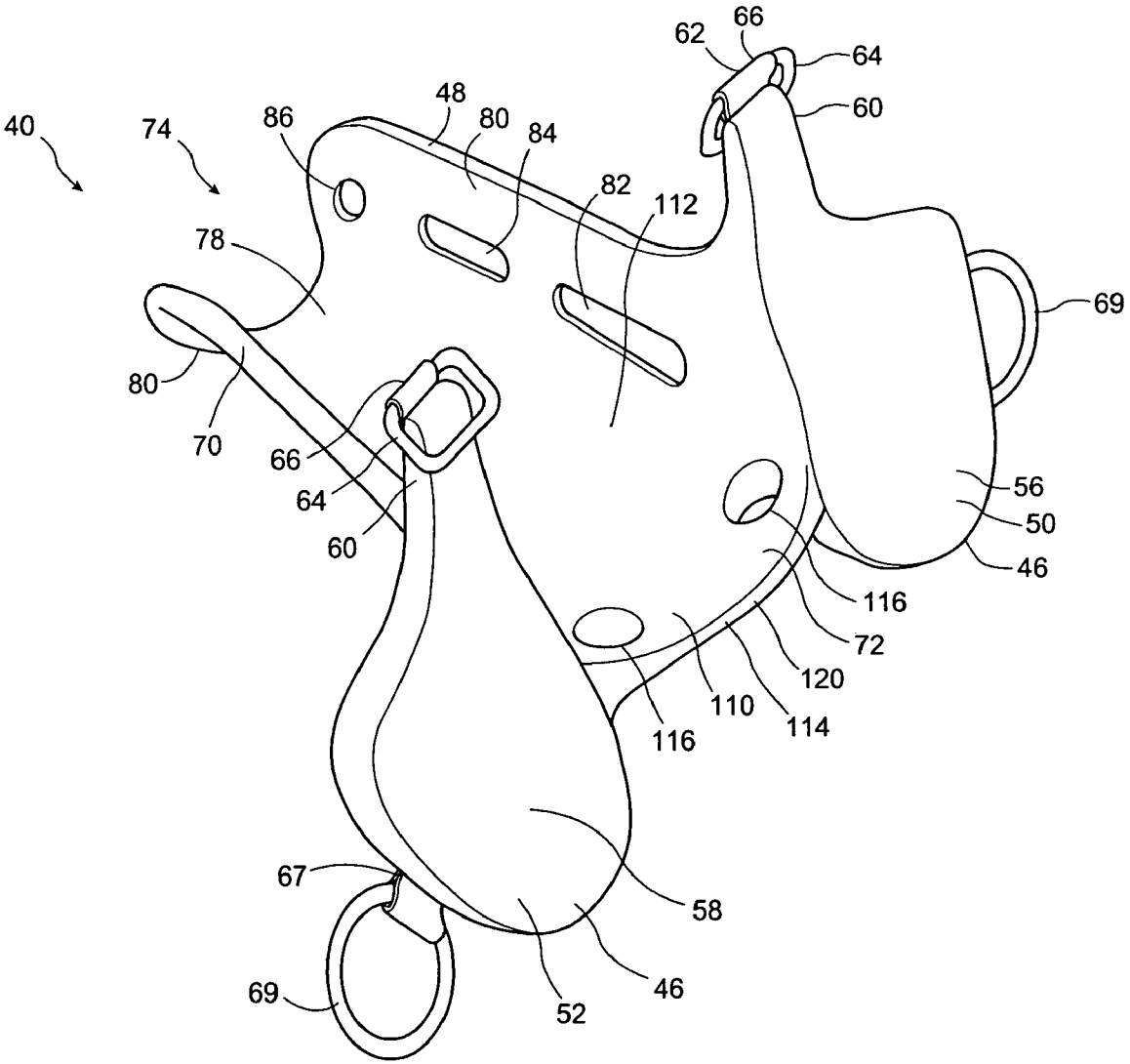
FIG. 3*c* shows a perspective view of the crupper of FIG. 3*a* from above, in front, and to the right.

The description that follows, and the embodiments described therein, are provided by way of illustration of an example, or examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

By way of a general overview, FIG. 1*a* shows a harness 10 for an animal, such as a horse 12. Harness 10 may include a breast collar 14 that extends about the fore quarters of the horse beneath the base of the neck, a sursingle 16 and crupper assembly 20. Sursingle 16 extends about the girth of horse 12, and includes a sursingle belly band 18 that extends beneath the horse's belly and a sursingle back 22 that extends over the horse's back. Breast collar 14 is maintained in position relative to sursingle 16 by upper and lower breast collar straps indicated respectively as 24 and 26. Crupper 20 is mounted to the rear end of horse 12, and may be maintained in position by a pair of turnback straps 28 that extend from the top of the sursingle, over the hindquarters of the horse, and which connect to the top or upper portion of crupper assembly 20, as is more fully described below. Turnback straps 28 are adjustable in length, and so govern the longitudinal distance along the back of horse 12 between the top of sursingle 16 and crupper 20. Lateral position of crupper assembly 20 may tend to be maintained by the use, and suitable adjustment, of upper, lower, and rearward spider straps 30, 32, and 34. Upper spider strap 30 runs from the top of sursingle back 22 generally rearwardly and diagonally to a node, or ring, 36. Lower spider strap 32 runs from a D-ring at one end of the center portion of the bottom of sursingle belly band 18, generally diagonally upwardly and rearwardly to ring 36. Rear spider strap 34 runs rearwardly about the contours of the flank of horse 12 to attach to crupper 20, as will be described below. As will be appreciated, while right hand straps are visible in the figure, corresponding left hand spiders straps extend on the opposite side of horse 12 such that the forces in the straps relative to the lateral positioning of crupper assembly 20 may tend to be more or less symmetrically balanced such that crupper assembly 20 may tend to be maintained in a central position to support the horse's tail in general longitudinal alignment with the spine of the horse (which, for the purposes of this description lies ideally in a fore-and-aft longitudinal vertical plane).

Crupper assembly 20 may include a crupper frame, referred to hereinafter simply as crupper 40, discussed in greater detail below, padding 42, and a leather cover 44. Crupper 40 has a compound concave surface that is fabricated to conform to the compound curvature of a horse's hindquarters adjacent to the root of the spine. Padding 42 is mounted to sit between the curvature of crupper 40 and the skin of horse 12. For other animals, a different curvature may be used, such as may correspond to the customary shape of that animal. Leather cover 44 is sewn to padding 42, the whole assembly of cover and padding fitting over the greater part of crupper 40. The terminology "crupper" may, depending on context, refer to either the entire assembly, i.e., crupper assembly 20, or more specifically, to the rigid crupper frame, i.e, designated as crupper 40, alone.

The illustrations provided herein are based on photographic views of an example of a crupper 40 embodying the principles of the invention. Crupper 40 may be fabricated from a metal, such as aluminium, but may also be fabricated from other suitable materials. In general, crupper 40 may have a vertical-longitudinal plane of symmetry, allowing for the asymmetries and imperfections in production of castings, and, in particular, of sand castings.

Although crupper 40 may be formed as an integral, monolithic casting, crupper 40 can be thought of as having a base, or base portion, 46, and a trough portion 48. In general terms, base portion 46 has a pair of left and right hand pad portions, 50, 52 joined by a U-shaped web portion 54.

Pad portions 50 and 52 may each have a contoured inward surface 56, 58 that may be formed on a compound concave curvature, that is generally symmetrical about a vertical longitudinal central plane bi-secting trough portion 48, the two compound curved surfaces tending to lie on the same geometric surface, the curvature being intended to permit crupper 40 to conform, in a general sense to the curvature of the hindquarters of the animal, such as horse 12, or as the case may be. The compound curvature may be formed according to a geometric polynominal function, or may be formed on radii of curvature about respective vertical and transverse axes, the resultant compound curvature being formed generally to conform to the shape of a horse's hind quarters. To that end, the transverse radius of curvature may be of the order of 80–100 inches, and may be about 90 inches (+/−5"); the vertical radius of curvature may be of the order of 10–15 inches, and may be approximately 11½ inches (+/−1 inch). The resultant surface may tend to be an ellipsoid, or a reasonably close approximation of an ellipsoid given the possible imprecision of a sand casting, if such is employed. That is, the surfaces of the two pad portions 50, 52 would then be portions lying on the same ellipsoidal surface. Put alternately, the two surfaces may tend to lie on a common torus (i.e., doughnut) surface, where, converting the radii above, the main radius of the torus may be about 75–80 inches in the horizontal plane, and the minor radius of the torus may be about 10–15 inches. While it is desirable for this curvature to conform closely to the size of the hindquarters of horse 12, a layer of padding 42 may generally be placed between the surface of the crupper frame pad portions 50, 52, and may tend to take up a reasonable degree of imprecision.

Figure 4A:
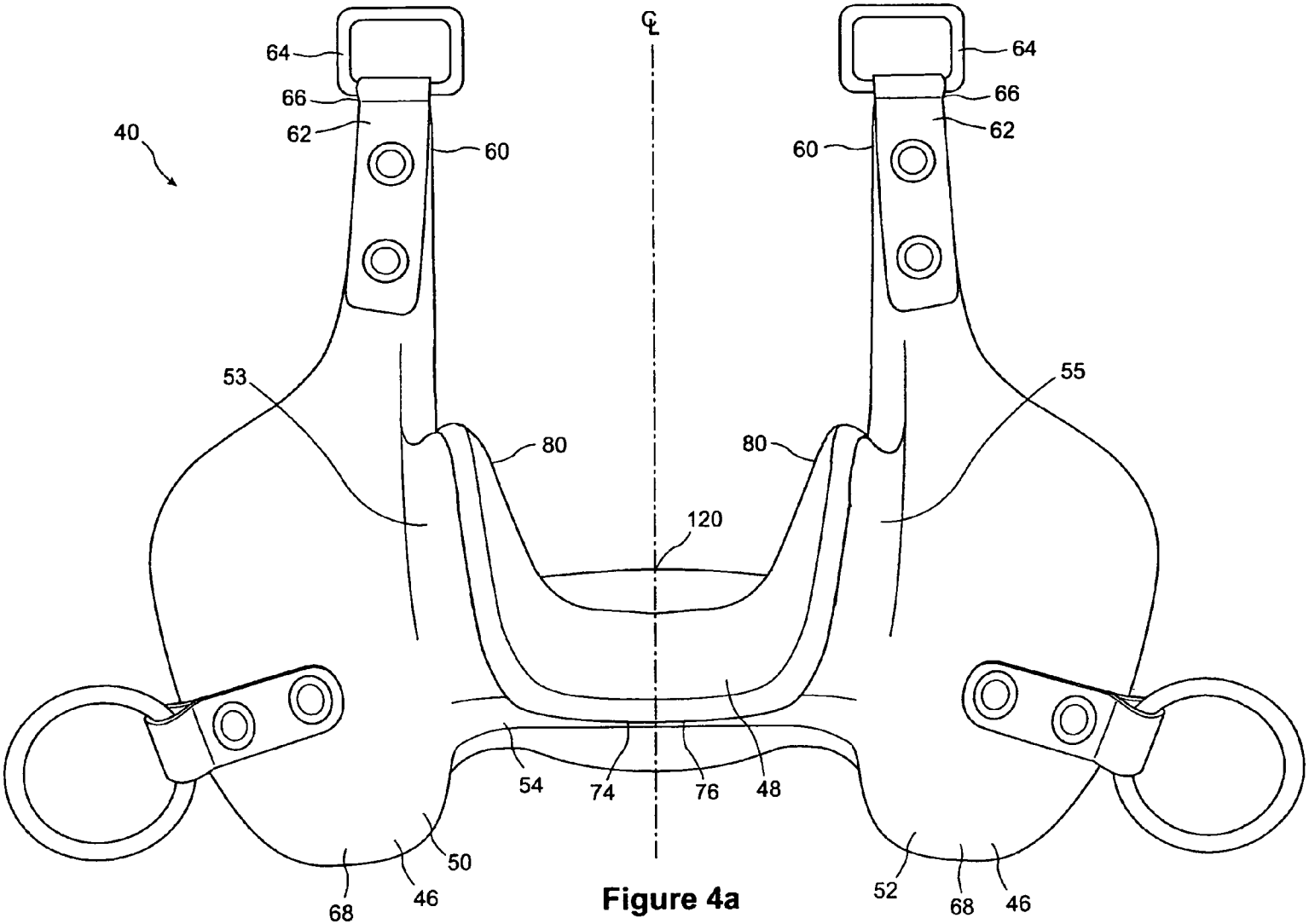
FIG. 4*a* shows a rear perspective view of the crupper of FIG. 3*a*, as suspended.
Figure 4B:
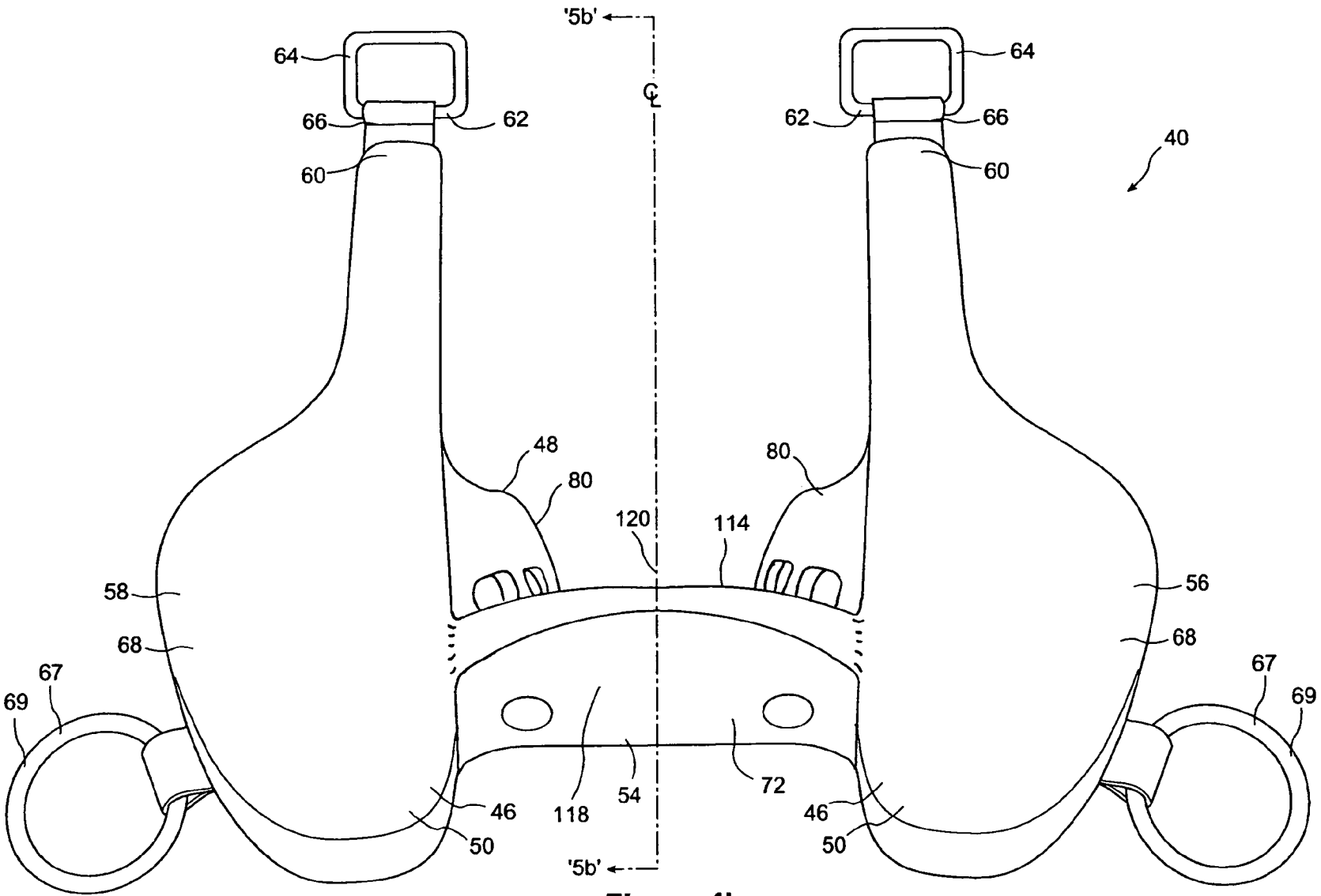
FIG. 4*b* shows a front perspective view of the crupper of FIG. 4*a;*
Figure 4C:
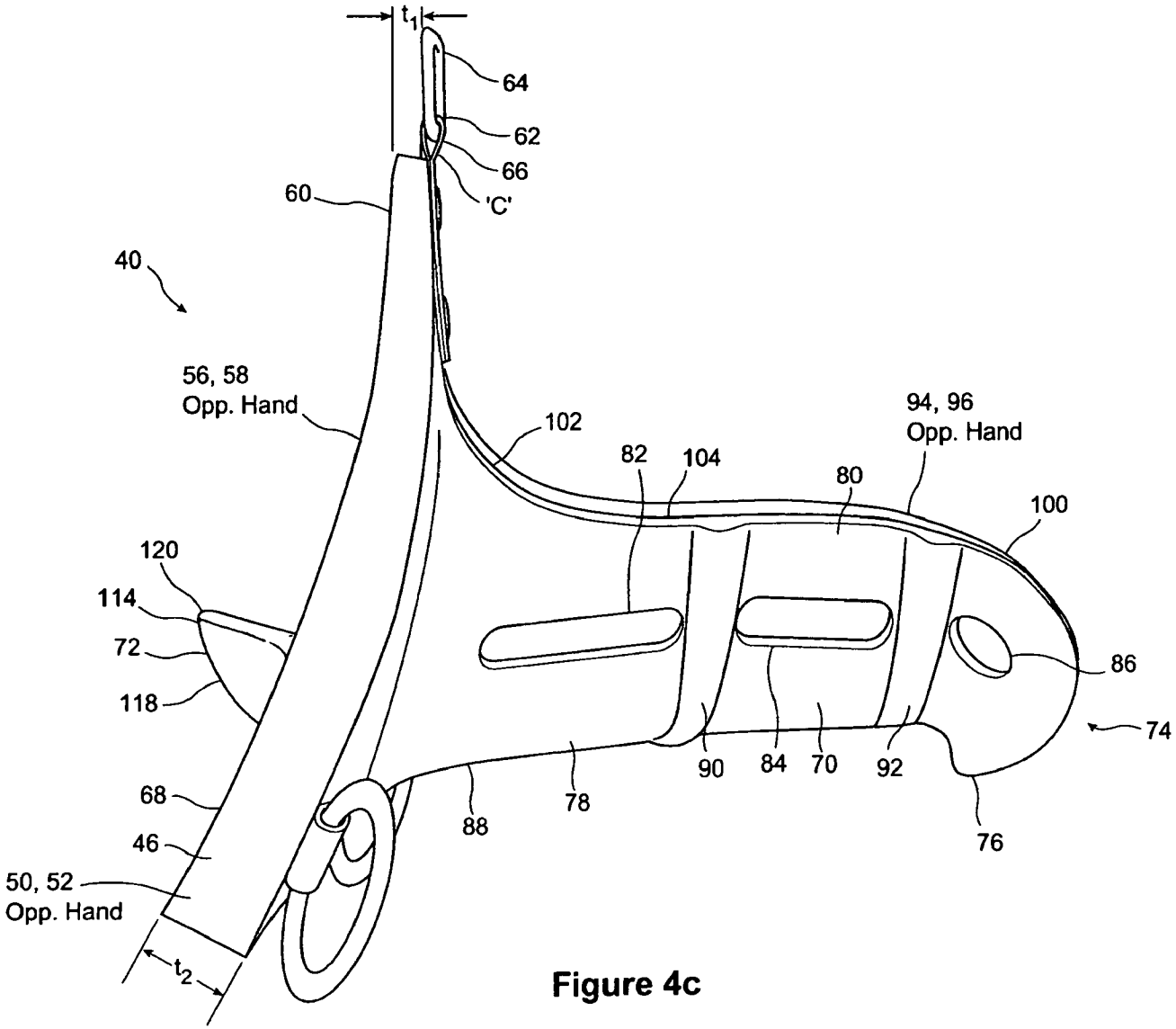
FIG. 4*c* shows a side perspective view of the crupper of FIG. 4*a*, as suspended.
Figure 4D:
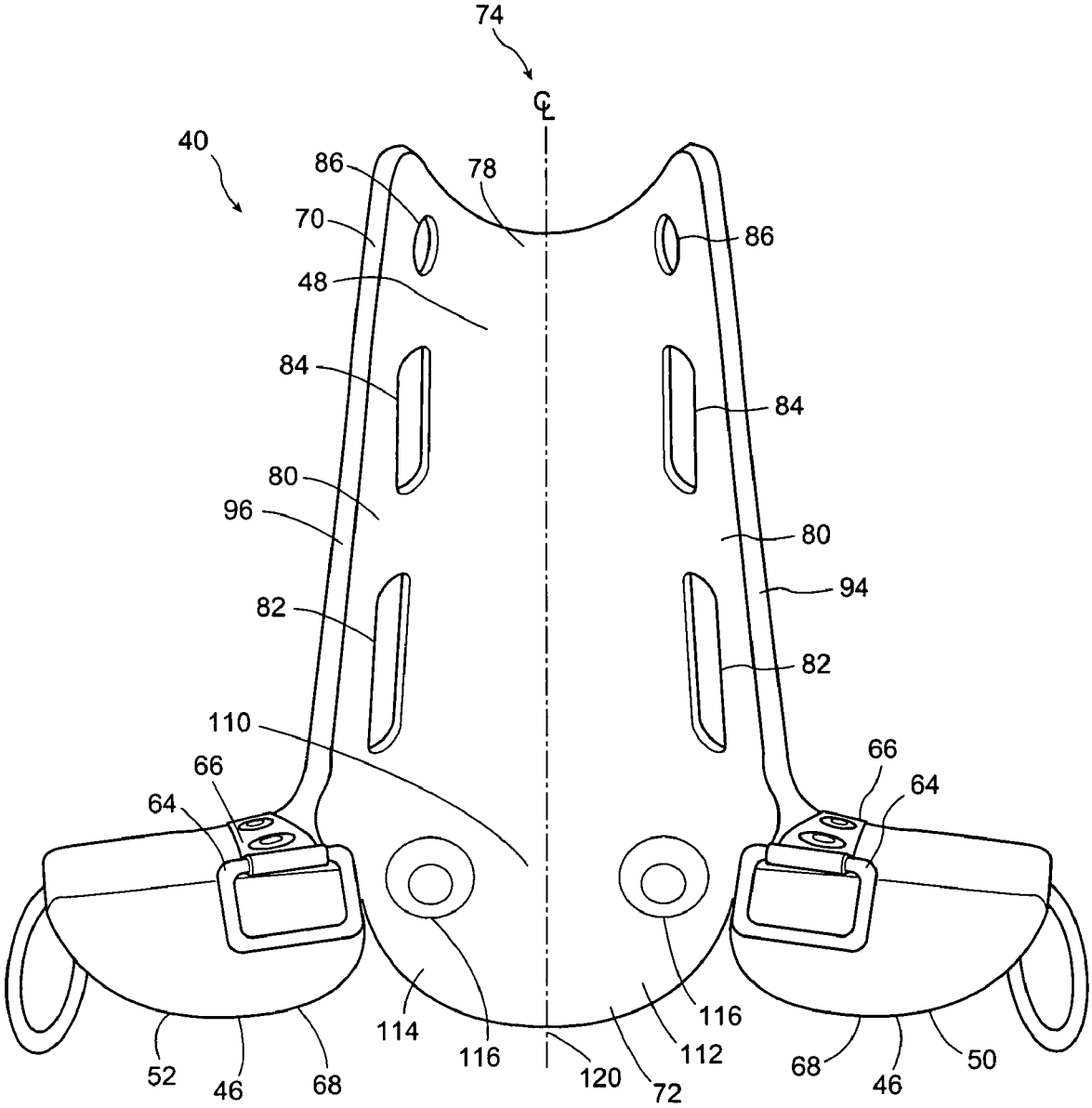
FIG. 4*d* shows a top perspective view of the crupper of FIG. 4*a;*
Figure 4E:
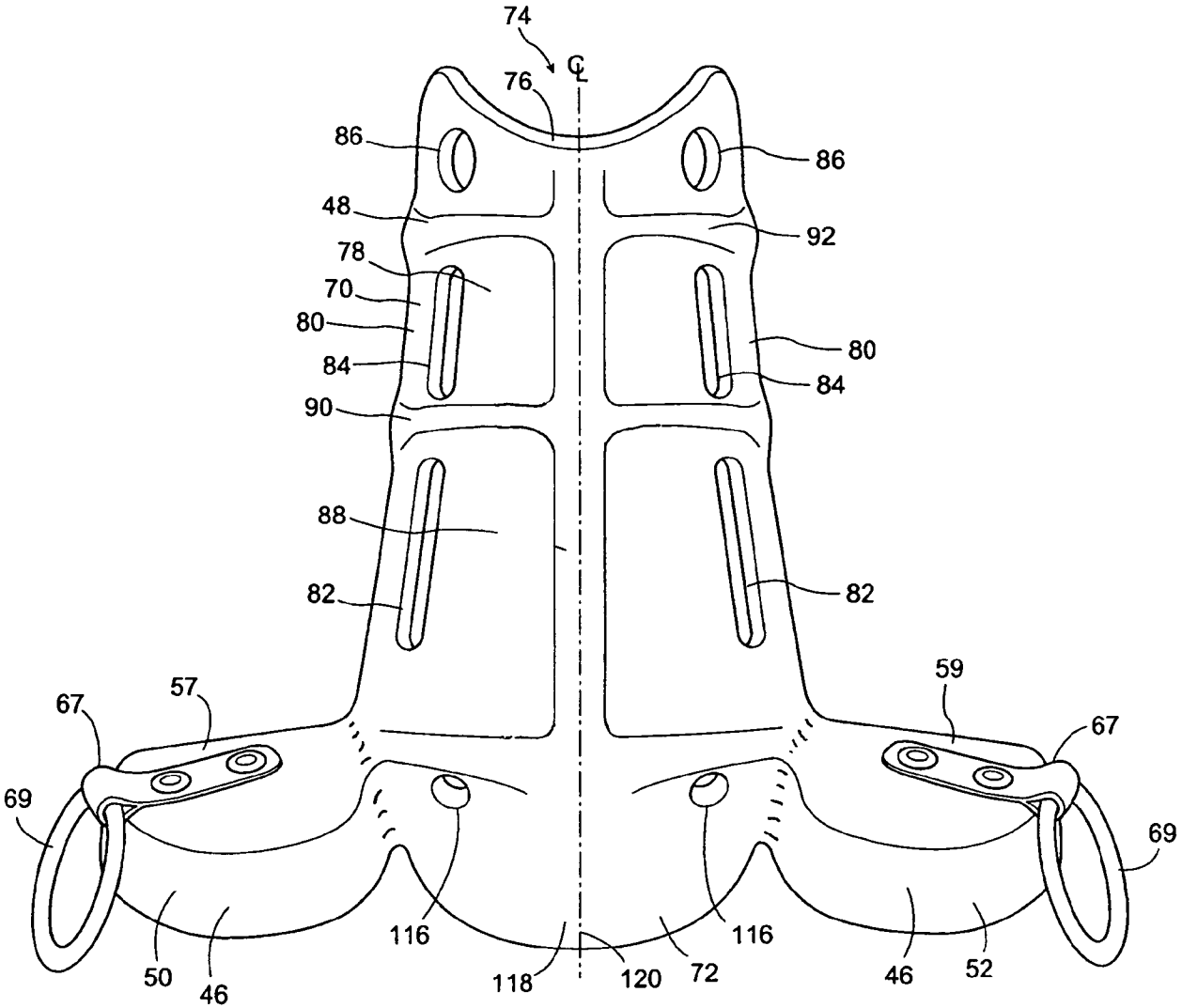
FIG. 4*e* shows a bottom perspective view of the crupper of FIG. 4*a;*

In one embodiment, the U-shaped web portion 54 may tend to have quite a square cornered, or three-sides-of-the-rectangle appearance, with slightly splayed legs. The splay may be about ±2 inch in width over about a 4 inch rise in height, giving a splay angle of about 3 to 4 degrees from either side of vertical for the respective sides, if the back portion is taken as being substantially horizontal in terms of the view shown in FIG. 4*a*. The back of this web portion 54 is sometimes referred to as the "bridge" between the left and right hand pad portions 50, 52.

Each of the pad portions 50, 52 may have a lower, rather wider region, that may be smoothly radiused along the laterally outboard portions at its upper end to give onto an upper, narrower region or tail, or toe 60 (left or right hand, respectively). At the distal or upper extremity of each tail, or toe 60, is a strap attachment fitting 62, such as a rectangular ring, or eye, 64, whose hinge fitting 66 may be riveted in place. Given that the general use environment may tend to be acidic, mechanical fasteners in the nature of galvanically suitable rivets may be used, such as copper rivets being used in an aluminum casting with stainless steel hinge fittings, for example. The lower lobate regions 68 of pads 52, 54 also have mounting fittings 67, such as may be in the nature of hingedly mounted ring fittings 69 that may be mounted to the laterally outermost extremities of the outer surface 57, 59 of the wings (namely lobate regions 68) of crupper 40. Fittings 67 may be employed as connection points for rearward spider straps 34, whereby the lateral positioning of crupper 40 may be adjusted.

Trough portion 48 may include an outboard, or rearward portion 70 that, in use, extends outwardly and upwardly away from the hind quarters of the animal, and an inward portion, or tongue, or wedge 72 that extends inwardly of the surface of the body of revolution on which surfaces 56 and 58 of pad portions 50 and 52 are formed. Rearward portion 70 has the tapering form of a nozzle or chute, that, at its broad, proximal end adjacent pad portions 50, 52 forms a smooth transition into the web, or bridge portion 54 of base portion 46. At the distal end of rearward portion 70, the tapered chute region gives onto a somewhat curved, slightly broadening bell mouth 74 with a downwardly opening arcuate lip 76. The chute has a base, or bottom portion, 78 and side portions 80, and may include lightening reliefs 82, 84 and 86 in the nature of elongate apertures having radiused ends, those apertures providing a demarcation between the region of the bottom portion 78 of the trough and the side portions 80 of trough portion 48. Trough portion 48 may include a centrally positioned, longitudinally extending external reinforcement rib, or spine, 88, and may include transversely oriented, integrally formed ribs 90, 92 that may emanate from spine 88 and extend peripherally about thereabout from side to side. Ribs 90 and 92 may be located at roughly the ½ and ¾ longitudinal stations between base portion 46 and lip 76.

The outer surfaces 57, 59 of pad portions 50, 52 may also be curved, but in such a way that the through thickness t at the extremity of toes 60 may be substantially less than the through thickness $t_2$ at the lowest extremity of lobate regions 68. For example, the upper thickness may taper to thickness $t_1$ of about half an inch, or less. The lower thickness may broaden to thickness $t_2$ of roughly about an inch (+/−⅛"), and the variation in thickness may be a smoothly continuous increase as a function of position along the arc. This may tend to result in a disproportionate biasing of the weight distribution of the pads toward the lower extremity.

The upper edges or margins of the side portions 80 of the trough portion 48 are indicated as 94 and 96, and have a profile indicated as 98. Profile 98 includes an outward end portion 100 and an inward portion 102. Outward portion 100 is downwardly concave, with local radii of curvature having local centers of curvature lying below trough portion 48. Inward portion 102 may be smoothly radiused on a relatively large radius fillet to run smoothly into toe 60. The radius of the fillet may be of the order of 1±2 inches. The radius may run on a smooth spline fit into outward portion 100, the two portions being tangent fit, with a point of inflection 104 where the curves meet. The center of curvature inward of this point (i.e., toward horse 12) lies above the profile, rather than below it. In mathematical terms, at the point of inflection the second derivative of the profile, $d^2y/dx^2$, is zero as it changes from negative (outward of the point of inflection) to positive (inward of the point of inflection). A construction line is provided, and labelled as 'B', to show where a continuation of the outward portion 100 of the curve might otherwise intersect the curved surface of the body of revolution defining the compound curvature of the respective inward surfaces 56, 58 of pad portions 50, 52.

The bottom portion or region 78 of the trough portion 48 and tongue 72 may sometimes be referred to as the "spoon" of the crupper. The inner region of the spoon is indicated generally as 110. This region may protrude a distance, δ, significantly beyond, or proud of, (that is, inwardly proud of) the surface of the body of revolution of the inner surfaces of pad portions 50, 52. That distance may be of the order of about 1–2 inches, and may be about 1½ inches, or, expressed alternately, of between about 20% and about 50%, and possibly between about ¼ and about ⅓, of the width of trough portion 48 at the juncture thereof with base portion 46.

Figure 5A:
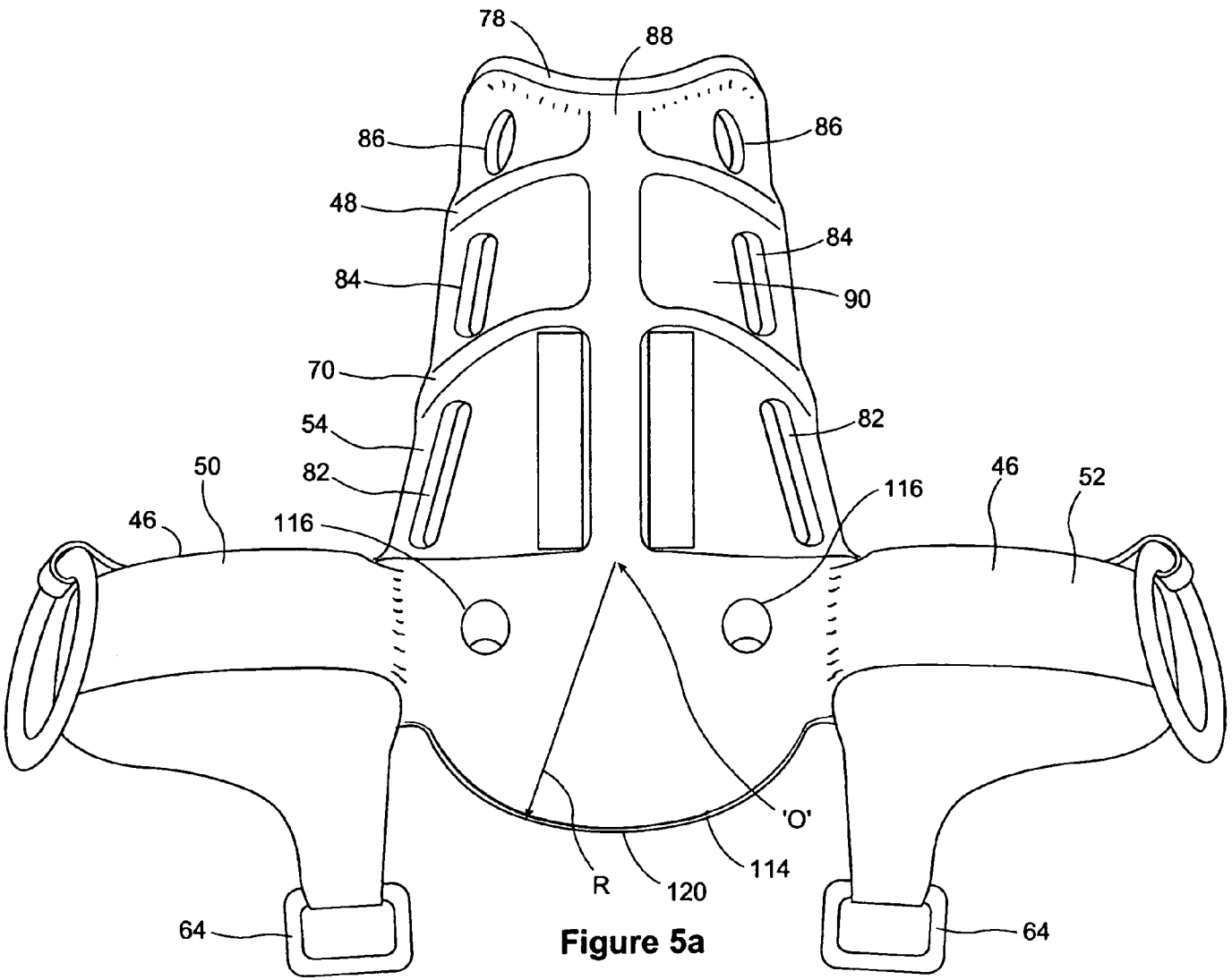
FIG. 5*a* shows a view taken substantially normal to a wedge surface of the crupper of FIG. 4*a;*

The upper surface 112 of the inside of trough portion 48 has a shape somewhat like the bowl of a spoon, with a relatively smooth, continuous cupped surface (hence the "spoon" terminology). The inner edge of the bowl of the spoon terminates at an arcuate edge 114, that may tend to be a portion of a roughly circular arc, that may tend to lie in a plane. Crupper 40 may include drain holes 116 such as may tend to discourage the accumulation of moisture in the bowl of the spoon. The outside, or lower, surface 118 of the tongue portion 72 is sharply angled relative to the arcuate profile of longitudinal reinforcement rib 88, the two surfaces running into each other along a radius formed at the back of the web portion 54 of the bridge. Again, there is a marked change in the profile, from a curve having an outward and downward center of curvature, to one having an upward radius of curvature. Although surface 118 is slightly crowned both longitudinally and laterally, taking surface 118 as being generally planar, the general change of direction of the profile at this point may be in the range of 40 to 60 degrees of arc indicated as angle ϕ, and may be about 45 to 50 degrees from the tangent of the surface of longitudinal rib 88 at the juncture of the curves. The arcuate wedge that is formed in this way may tend to seat between the buttocks of the animal, and may tend to discourage dislodgement in a manner not observed in previous cruppers. The arcuate wedge edge 114 may be formed on a curve, seen from above, having a radius R of between 2" and 2½", and may be about 2¼". The center of curvature may lie on the crown of web portion 54 i.e., at the location marked 'O' in FIG. 5*a*. The arcuate inner edge may be smooth, as opposed to dimpled or crenellated. The arcuate edge may run through 120–180 degrees of arc, and may be about 140 degrees of arc (+/−10).

Certain geometric relationships between the forgoing elements may be observed. First, as compared to existing cruppers, the center of gravity CG, of crupper 40, as viewed from the side may tend (a) to be relatively low; and (b) may tend to lie relatively close to the bottom of trough portion 48, and may tend to lie relatively close to the surface of the body of revolution corresponding to the curvature of pad portions 50 and 52. In contrast to previous cruppers, in which some effort may have been made to keep the crupper weight relatively low to lessen the weight (and, it may have been thought, possibly the discomfort of the animal), the present inventor has, counter-intuitively, increased the weight of the crupper, and altered the position of the center of gravity, to locate it lower on the crupper, and closer to the juncture of the base portion and the trough portion, as seen in side view such as in FIG. 5*b*. The size of pad portions 50, 52, the substantial through thickness of the pad regions and the freedom of the pad regions of lightening reliefs, may all tend to contribute to this effect of both increasing the mass and concentrating it in the lower regions of the pad portions.

Figure 5B:
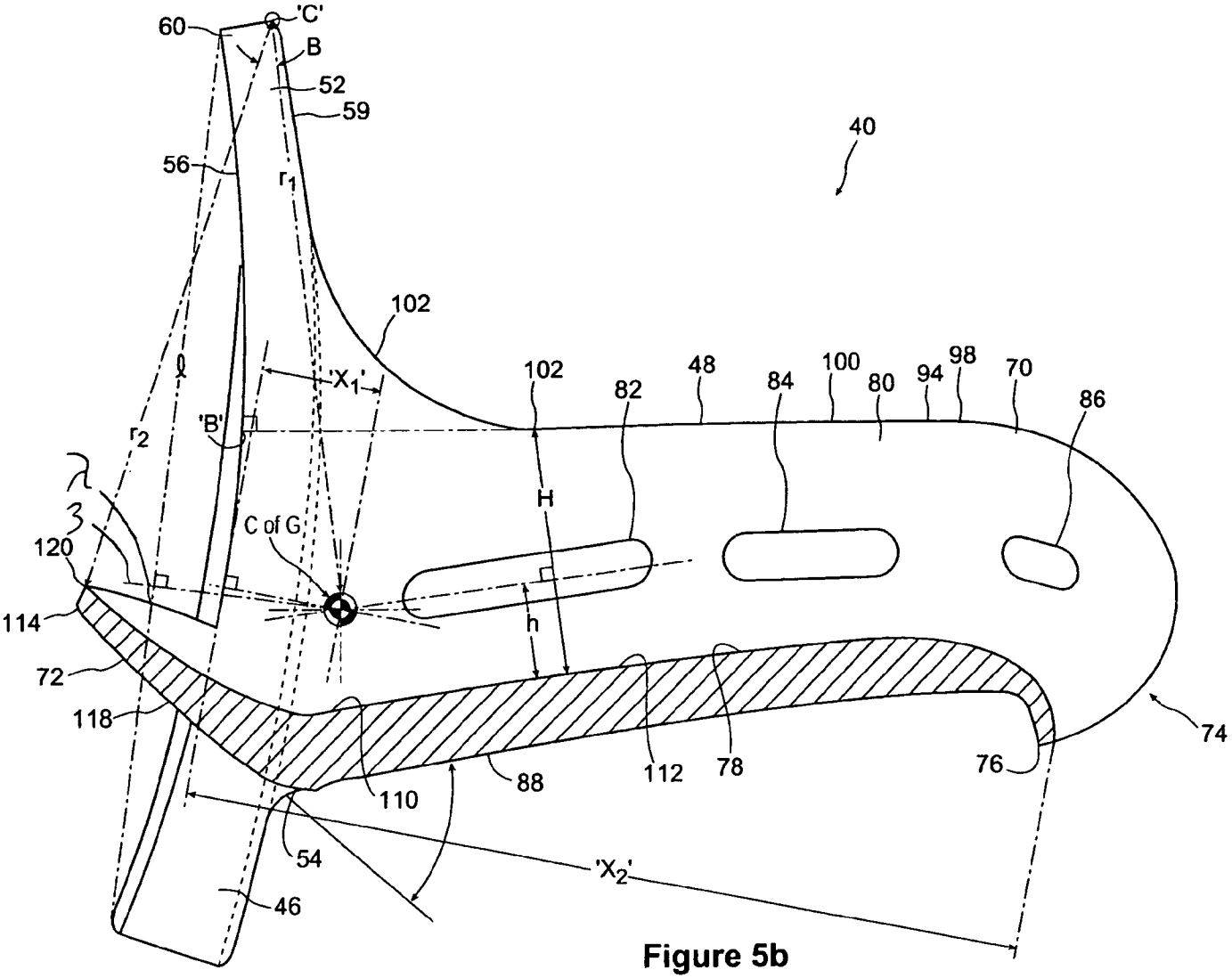
FIG. 5*b* shows a cross-sectional view taken along the longitudinal centerline of the crupper of FIG. 4*a*, indicated by section '5*b*–5*b*' of FIG. 4*b*.

Looking at the cross-section in side view of FIG. 5*b*, drawing a chord l between the upper and lower vertices of the inner pad surface 56, 58, a perpendicular line ξ through the CofG may tend to intersect chord l in the range of less than half of the chord length from the lower vertex, and may be about ¼ to ½ of that chord length, or may be about ⅜ (+/−) of that chord length, from the lower, or bottom vertex. Again, expressed somewhat differently, the location of that intersection may be less than 10% of the chord length away from the location λ at which the upper edge of the lip of tongue 78 intersects chord l. Put differently again, taking the depth H of trough portion 48 as an altitude lying in a plane extending upwardly from the inside surface to the point of inflection of the sidewall profile, and taking a perpendicular projection from that altitude, the CofG may tend to lie at less than ⅔, perhaps less than half, of that height. Put alternatively, the perpendicular altitude h of the CofG may be at a height that is less than 1½ in., and may be less than 1 in., above the inside bottom centreline of trough portion 48. Expressed somewhat differently again, where a moment arm $r_1$ may be constructed from the center 'C' of the hinging point of the upper hinged attachment fittings (namely those on toes 60), to the center of gravity, and a reaction moment arm $r_2$ can be constructed between the center of the hinge and the apex 120 of the arc of the wedge portion, those moment arms may have substantially similar lengths (the first being less than 20% different from the second, and perhaps less than 10% different. Further, these moment arms may subtend an included angle that is relatively small. β may be less than 40%, may lie in the range of 20 to 30 degrees and may be about 25 degrees. Looking at the relationship of the CofG in the other direction, namely normal to the surface of the body of revolution shared commonly by the surfaces 56, 58 of pad portions 50 and 52, nearest the animal, the CofG may lie a distance X that may be less than 1±2 inches from the surface, and may lie about 1 inch from the surface. Taken as a ratio of the overall normal distance '$X_2$' from the arcuate surface to the lip 76 of trough portion 48, the CofG may be between 15% and 20% of the distance from the compound surface to the trough lip, and in one embodiment may be about 17% of that distance.

Figure 5C:
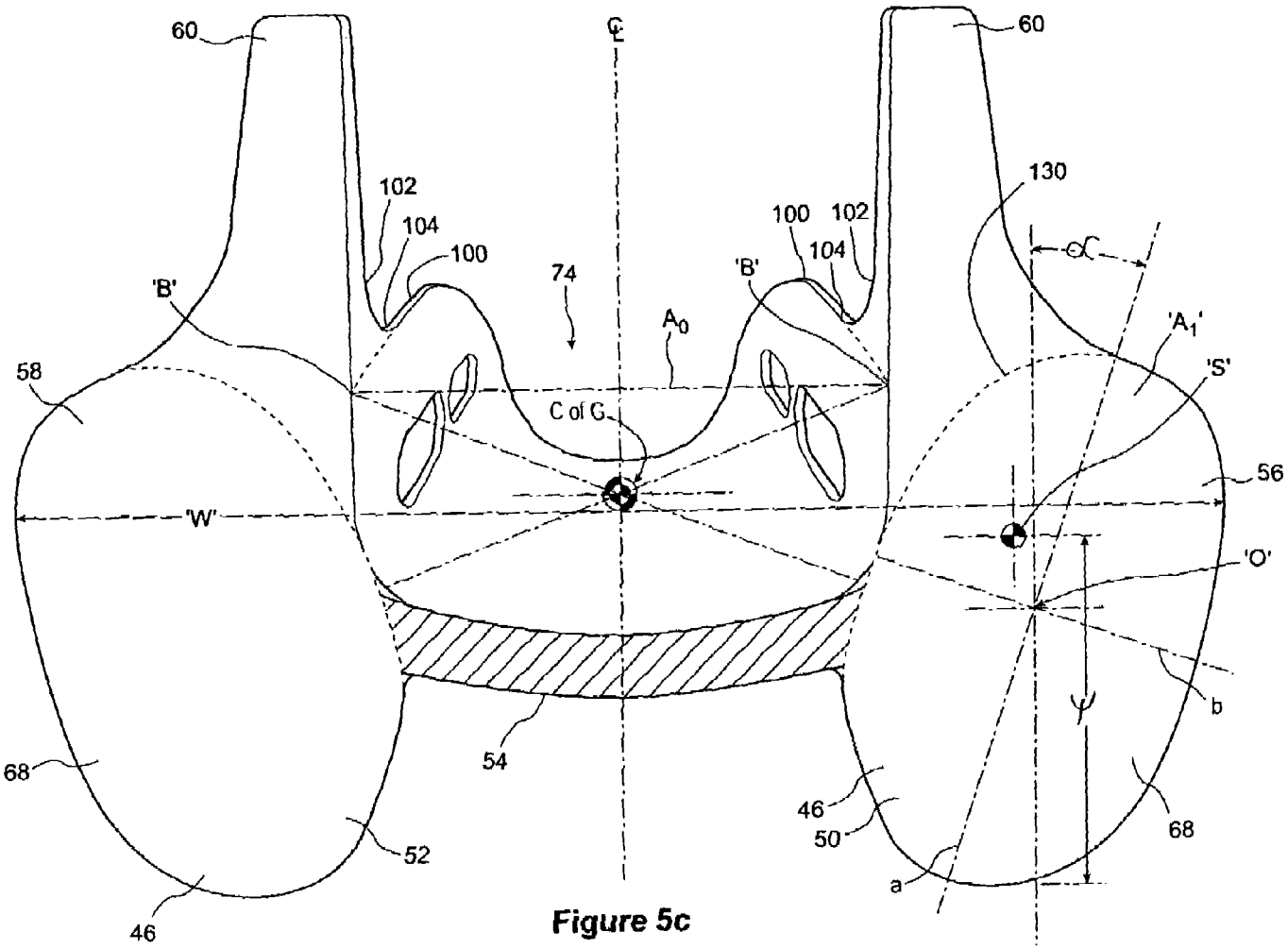
FIG. 5*c* is a partial sectional perspective view, as seen from the center of the radius of curvature of the crupper of FIG. 4*a*, abreast of the curved surface profile thereof.

FIG. 5*c* is drawn as if the toroidal surface had been laid flat and unfolded, with a section through the spoon at the root of tongue 72. The developed surface so exhibited may have a number of features. First, the size of each pad portion may be such that, although crupper 40 may be significantly heavier than earlier crupper castings, forgings or stampings, the surface area over which this weight is spread may tend to be proportionately even greater, such as may tend to yield a lower overall footprint pressure and broader spreading of weight, with possible consequent increase in comfort (or, alternately expressed, a reduction in discomfort) for the animal. That is to say, crupper 40 may weigh more than 4 lbs. and may weigh in the range of 4 to 7 lbs. and may be about 4¼ to 6 lbs. In one embodiment crupper 40 may weight about 4.8 lbs. The surface area of each pad portion facing the animal may be of the order of 12 to 20 sq. in., and may be about 16 in. sq., (+/−1 sq. in.). This may be seen in contrast to previous designs in which it appears that attempts may have been made to keep the crupper relatively light. In one embodiment, a crupper weighed approximately 1.6 lbs., in another, about 2.6 lbs.

This area can be also be expressed in proportion to the cross-sectional area of the trough. That is, upper vertices 'B' of a cross-sectional area of the trough may be defined by projecting a normal to the body of revolution from the point of inflection 104 of the local trough wall height (that is, the point at which the large radius fillet is tangent fit into the trough, namely at the point of inflection where the second derivative of the curve changes from a negative value to a positive value, i.e., $d^2y/dx^2$=zero). The cross-sectional area of the trough below those points may then be taken as $A_0$. The area A, of each pad portion 50 or 52 may exceed the $A_0$, and may be about 1.2 $A_0$ to 1.6 $A_0$. In particular this area may be about 1.5 $A_0$.

In another geometric feature, the lower region of each pad portion 50, 52 may be such as to permit the construction of an inscribed ellipse 130 thereon (shown, in part, in dashed lines), the inscribed ellipse being the largest inscribed ellipse, by total area, that can be constructed thereon. The inscribed ellipse may have an aspect ratio of major axis 'a' to minor axis 'b' of between about 1:1 and 2.5:1, may have an aspect ratio in the narrower range of 5:4 to 7:4, and may in one embodiment have an aspect ratio between about 23:16 to 27:16. That inscribed ellipse may have a major axis 'a' that is skewed with respect to the vertical, and in which the angle of skew a may be between 0 and 30 degrees, or, more narrowly, may be between 6 and 20 degrees, or more narrowly may be between 10 and 15 degrees, and, still more narrowly, may be about 12 degrees of arc from vertical. The area of inscribed ellipse 130 may be more than half of the area of each pad portion 50, 52, and may be in the range of one half to four fifths of the area of each pad portion 50, 52, and in one embodiment may be roughly 7/10 of that area. Whereas the cross-sectional area of trough portion 48 as defined above may be of the order of 10 to 11 sq. in., the area of the inscribed ellipse of maximum size may be larger than the area of the cross-section of the trough, and may be in the range of 9/10 to 5/4 of that area, and may be about the same size, +/−about 10%.

In another geometric relationship, the centroid of area 'S' of each pad portion 50, 52 lies at a height ψ that may be roughly 3 i(+/−½) inches upward as measured along the surface of the body of revolution from the lowest extremity of lobate portion of each pad portion 50 or 52. This may be expressed as being between 35% and 45% of the full arc between the lowest extremity and the highest extremity, and, in one embodiment, may lie about 40% of the way along the arc. The centroid of area 'S' of pad portion 50, 52 may lie lower than the center of gravity CG, as illustrated in FIG. 5*c*. The distance by which it is lower may be less than one inch, and may be less than half an inch, or about half an inch in one embodiment. Similarly, the center of the ellipse 130 of maximum inscribed area may be below the height of centroid 'S', and may be below the height of the center of gravity, the distance being less than 1½ inches, and, in one embodiment, may be less than 1¼ inches, or about 1¼ inches. The ratio of moment arms measured from the hinge at the upper distal extremity to the height of the center of gravity as seen in FIG. 5*c* may be of the order of ⅔ to ⅘, and may, in one embodiment, be about ¾ of the corresponding moment arm measured to the center 'O' of ellipse 130.

The moment arm measured from the upper hinge point to the centroid of area 'S' and to the center of gravity CG may be of relatively similar magnitude, in one embodiment the difference being less than 20%. The physical significance of this is that where the center of gravity CG is relatively close to the centroid of area 'S', as in this case, the weight of crupper 40 may tend to be borne relatively evenly on the pad surfaces 56, 58, rather than predominantly along one edge or one corner, and may then result in a relatively even pressure distribution on the animal. The physical significance of the size, position, and orientation of ellipse 130 of largest inscribed area is similar—it is a measure of force distribution relative to the opposing geometry of the animal's body, such as may tend advantageously to be addressed by use of a relatively large pad size on a somewhat angled lobe.

Another geometric relationship involves the width 'W' of crupper 40, measured on the transverse arc. The overall width may be in the range of about 10–12 inches, measured over the widest points along the arc, and may, in one embodiment, be about 11 inches. The height of the widest point, or widest span, may also be generally in line with the height of the center of gravity as seen in FIG. 5*c*, such that the difference in height may be less than ½ inch, and may be less than ⅛ inch. Another measure in this regard is the spread of the centroids of pads 50, 52. In one embodiment that spread may be greater than 6 inches. In another embodiment that spread may be between 6½ and 8 inches, and, in another embodiment that spread may be about 7 inches. Another measure is the transverse spread of the centers of the ellipses of maximum inscribed area. That spread may be greater than 6½ inches, and may be in the range of 7–8 inches, and may be about 7½ *inches*. P*ut alternatively*, as *ratios*, where the width between the inside edges of the pad regions 50, 52 is taken at the height of the center of *gravity*, the ratio of trough inside width to overall span width may lie in the range of 3:8 to 1:2, and may be about 7:16. The corresponding ratio of trough width centroid span width may be of the order of ½ to ¾, and may be about ⅔, while the corresponding ratio of trough width to ellipse center span may be of the order of 50% to 70%, and may be about 60%. The physical significance of these lateral spans and ratios is that they may tend to be measures not only of greater extent and therefore greater mass in base portion 46, but also of the greater moment arm of rigid material to discourage twisting and dislodgement. That is, where the lateral fastenings to rearward spider straps 34 have a relative narrow span between the rings, it may be relatively easy for the animal to knock or twist the crupper sideways, and so dislodge it. However where the span is large in proportion to the animal (and, in the case of the ratios, in corresponding proportion to the size of tail set required), it may be much more difficult for the crupper to become dislodged, and the twisting moment required to twist the crupper out may also be higher. This may be so where, at the greatest span, the wing portions of the crupper (namely, of pad portions 50, 52 in general, and lower lobate portions 56, 58 in particular) lie abreast of, or at a roughly similar height to, the CofG, or at a range of height bracketing the CofG, of crupper 40 more generally.

An alternate crupper 140 is shown in FIGS. 6*a*–6*f*. Crupper 140 may be substantially the same as crupper 40 in many respects, and may have a similar, or identical side view profile, but may differ therefrom in being narrower across the trough portion 148 (that is, trough 148 may tend to be narrower than trough portion 48), and in having lobate pads 150 and 152 that are of significantly smaller size than pads 50 and 52 described above. Crupper 140 may be for a generally smaller horse than crupper 40. The central wedge 172 may tend to protrude as far, but may be somewhat narrower, such as half an inch narrower, roughly, than wedge 72 of crupper 40, with an arc having a radius R that may be about 2 inches rather than about 2½ inches, for example.

As with crupper 40, crupper 140 may have pads 150 and 152 having an inner surface 156, 158 (i.e., the surface facing toward the horse, or other animal) formed on a compound curvature, such as may conform, generally, to the rear end of the animal. Further, pads 150, 152, like pads 50, 52, may increase in thickness from one end to the other, with the region of greatest thickness at the lower end, indicated as the lowest extremity of lobate portions 168, and the region of least thickness being at the distal end of toes 160. As before, in one embodiment the least through thickness may be about ⅜ or ½inches, and the greatest thickness may be greater than ¾ inches, and may be about 1 inch (+/−⅛").

As with crupper 40, crupper 140, and, in particular, the lower lobate regions thereof, may be formed in a solid, monolithic form that may tend to be free of reliefs or lightening holes and such like, since it may be desirable for this portion of crupper 140 to be relatively heavy. This may tend to yield a center of gravity that is (a) in the arcuate direction, closer to the lower end of the pad regions of crupper 140 than might otherwise be the case; and in the radial direction, or the normal direction relative to the compound surface of the pad portions, closer to the compound surface than otherwise. The weight of crupper 140 may tend to be greater than 3 lbs., and may be in the range of 3 to 4 lbs.

Taking the arc length of the pads from top to bottom as l, and taking the difference in height between the centroids and the projection of the CofG normal to the compound surface as δ, the altitude of the centroids S of the pads may be within 10% of l from the height of the CofG as projected normal to the compound surface, such that δ/l may be 10% or less.

Figure 6A:
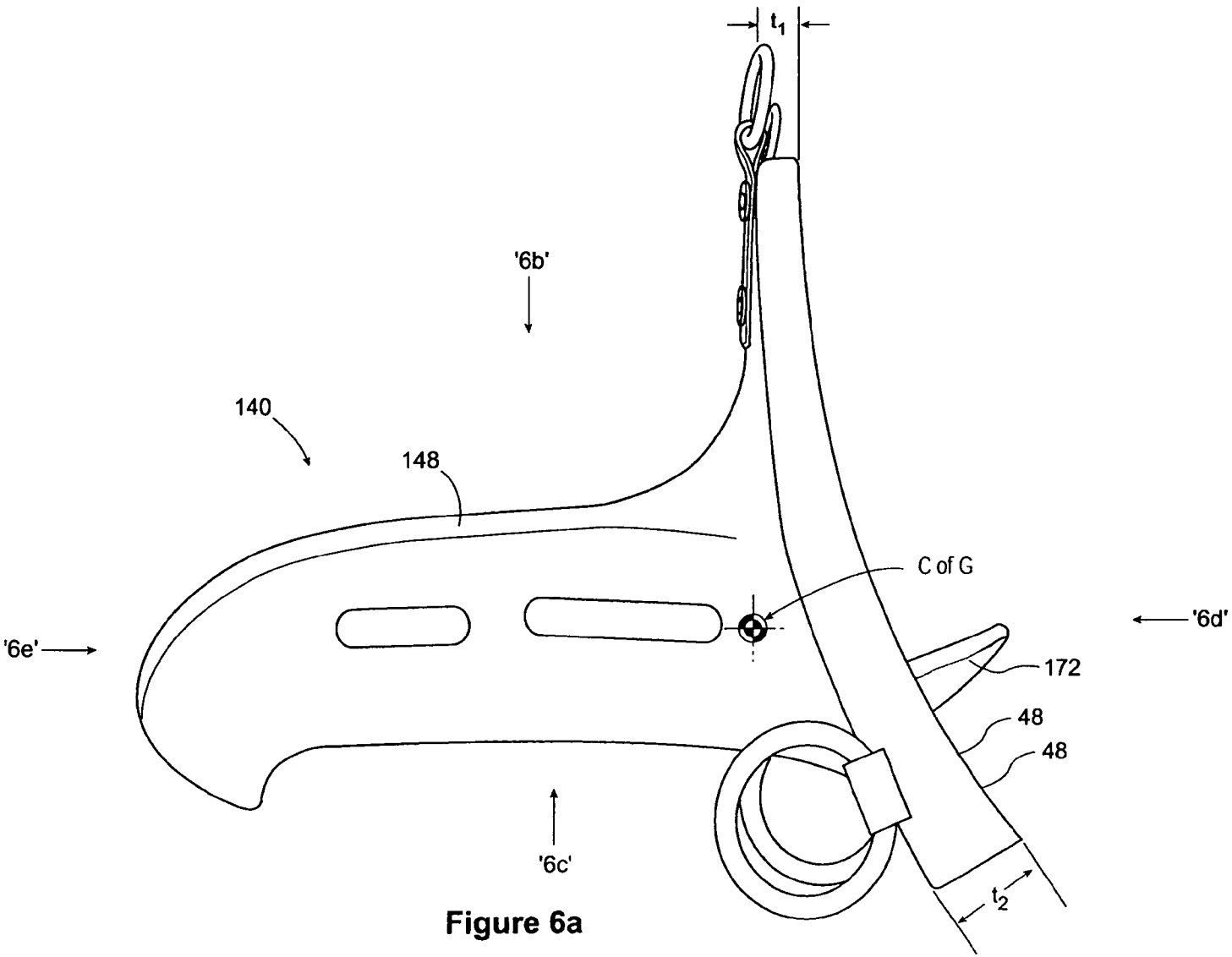
FIG. 6*a* shows a side view of an alternate crupper to that of FIG. 3*a;*
Figure 6B:
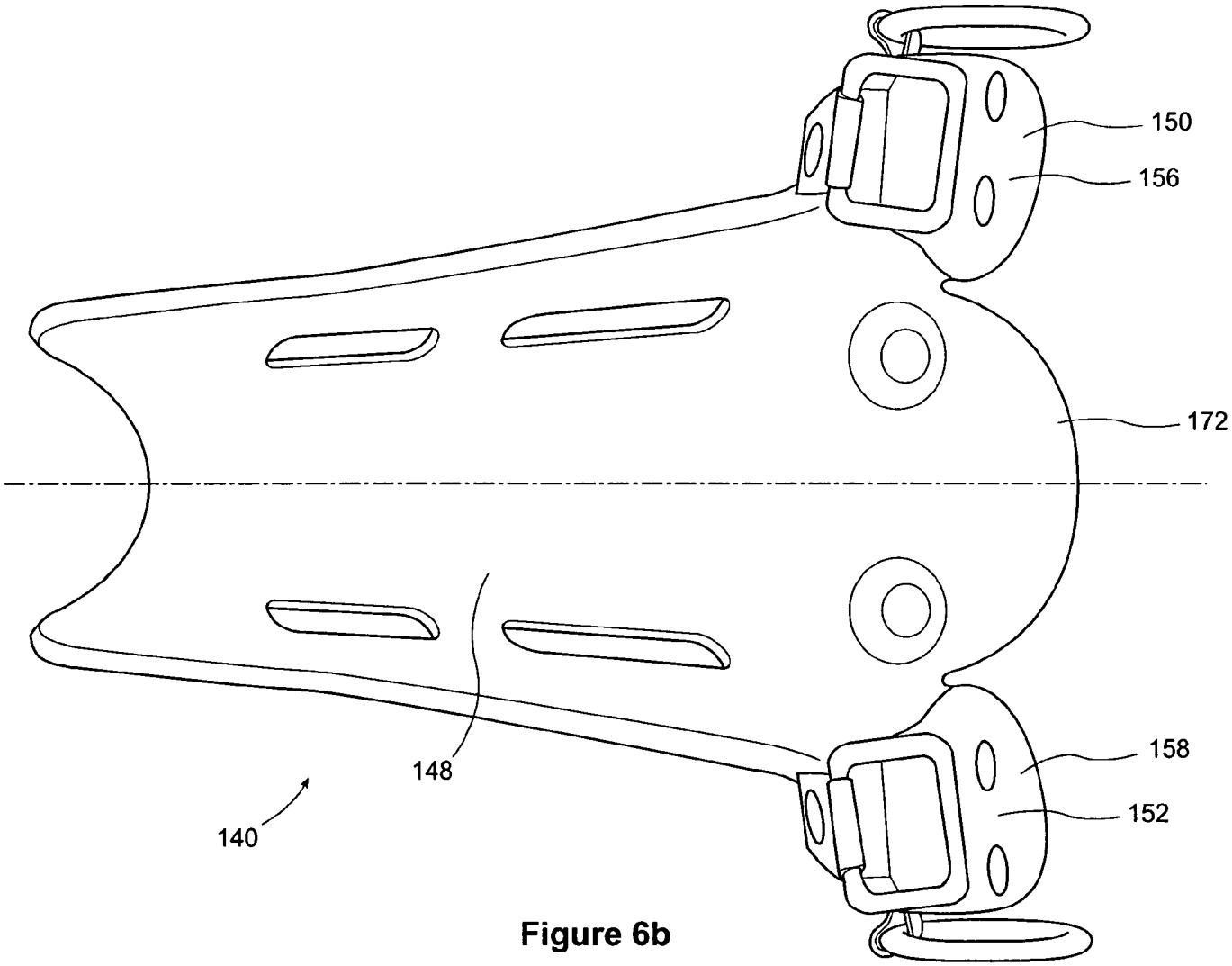
FIG. 6*b* is a view of the top of the crupper of FIG. 6*a*, taken on arrow '6*b'*.
Figure 6C:
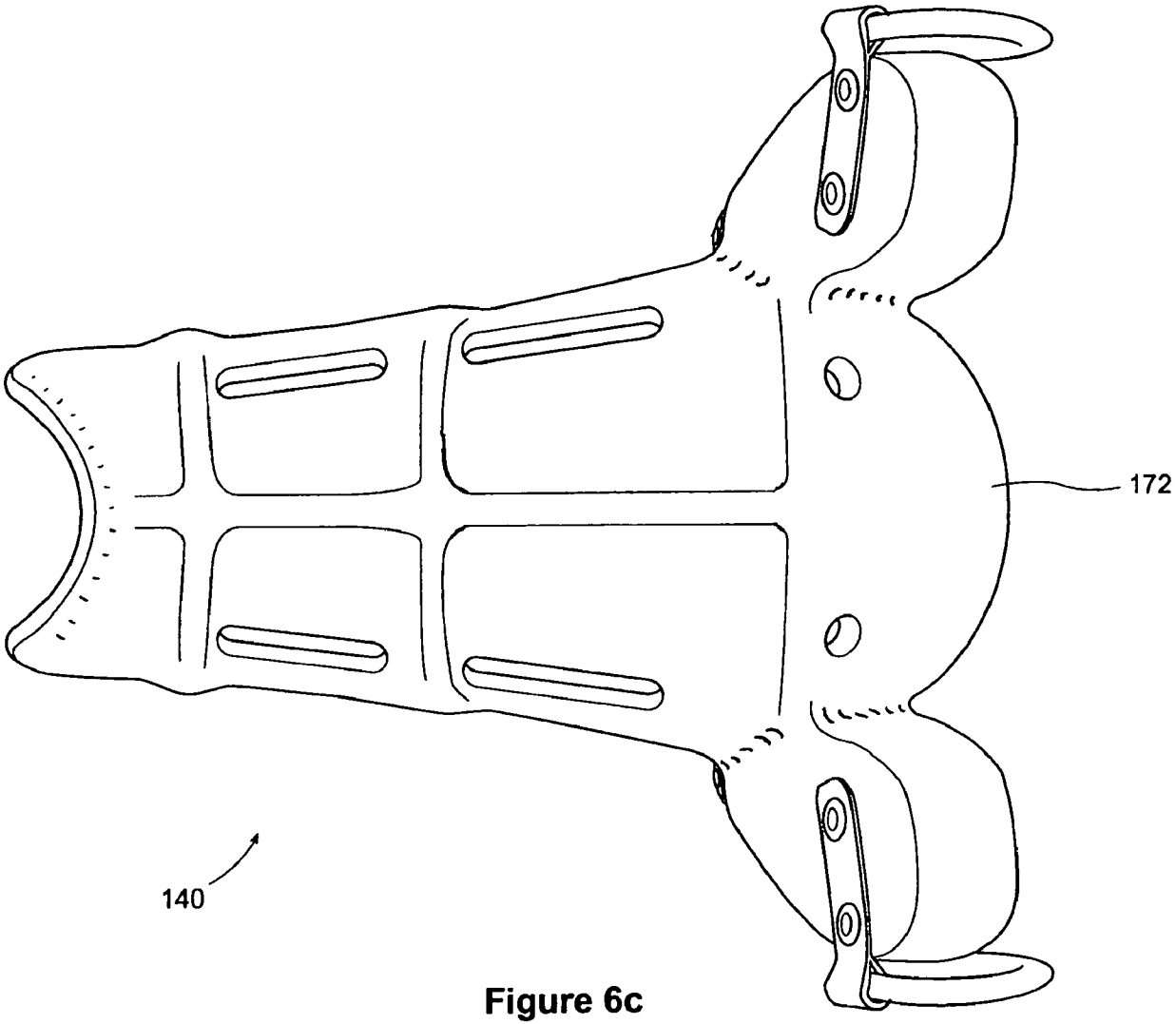
FIG. 6*c* is a view of the bottom of the crupper of FIG. 6*a*, taken on arrow '6*c'*.
Figure 6D:
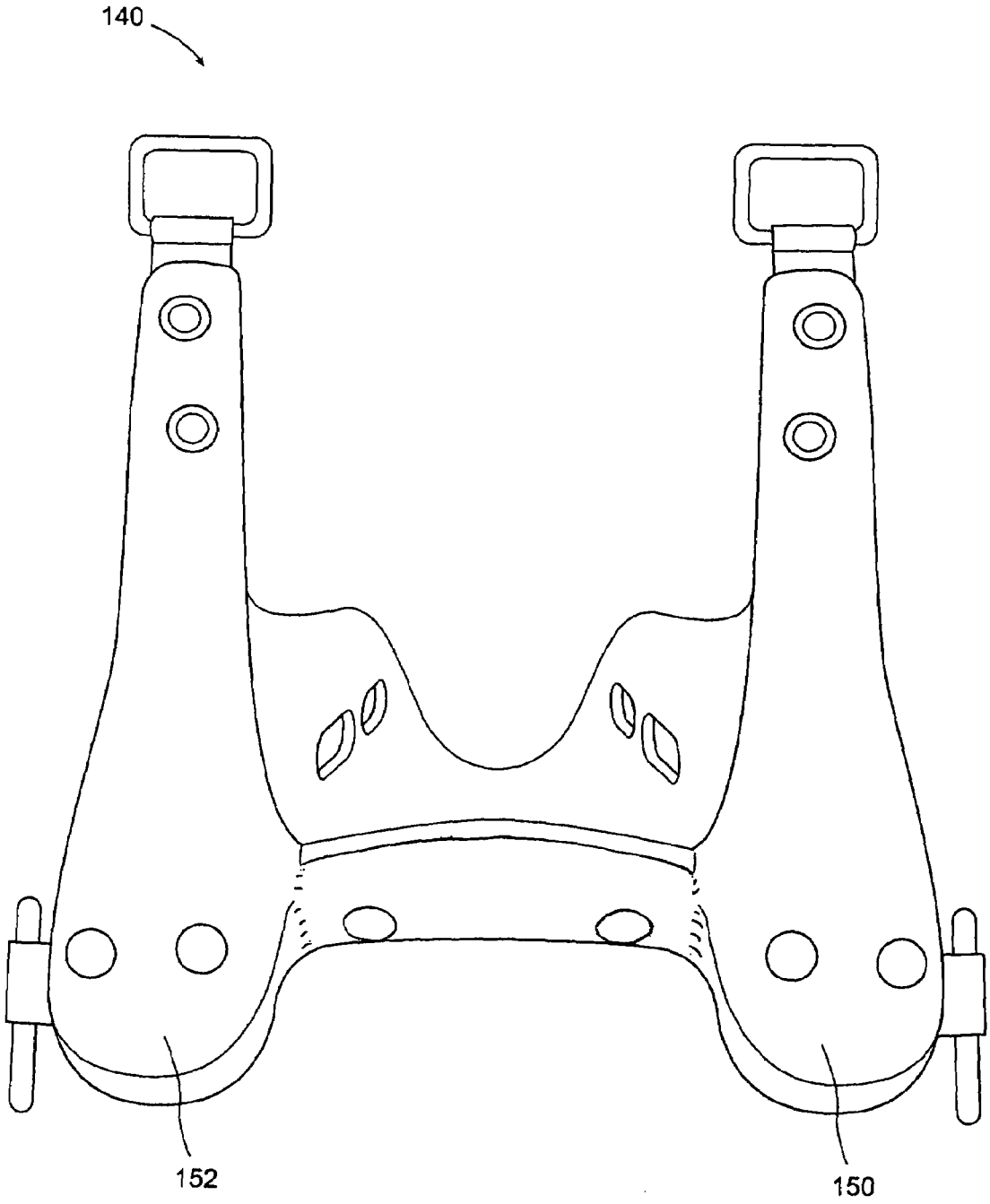
FIG. 6*d* is a near end view of the crupper of FIG. 6*a*, taken on arrow '6*c'*.
Figure 6E:
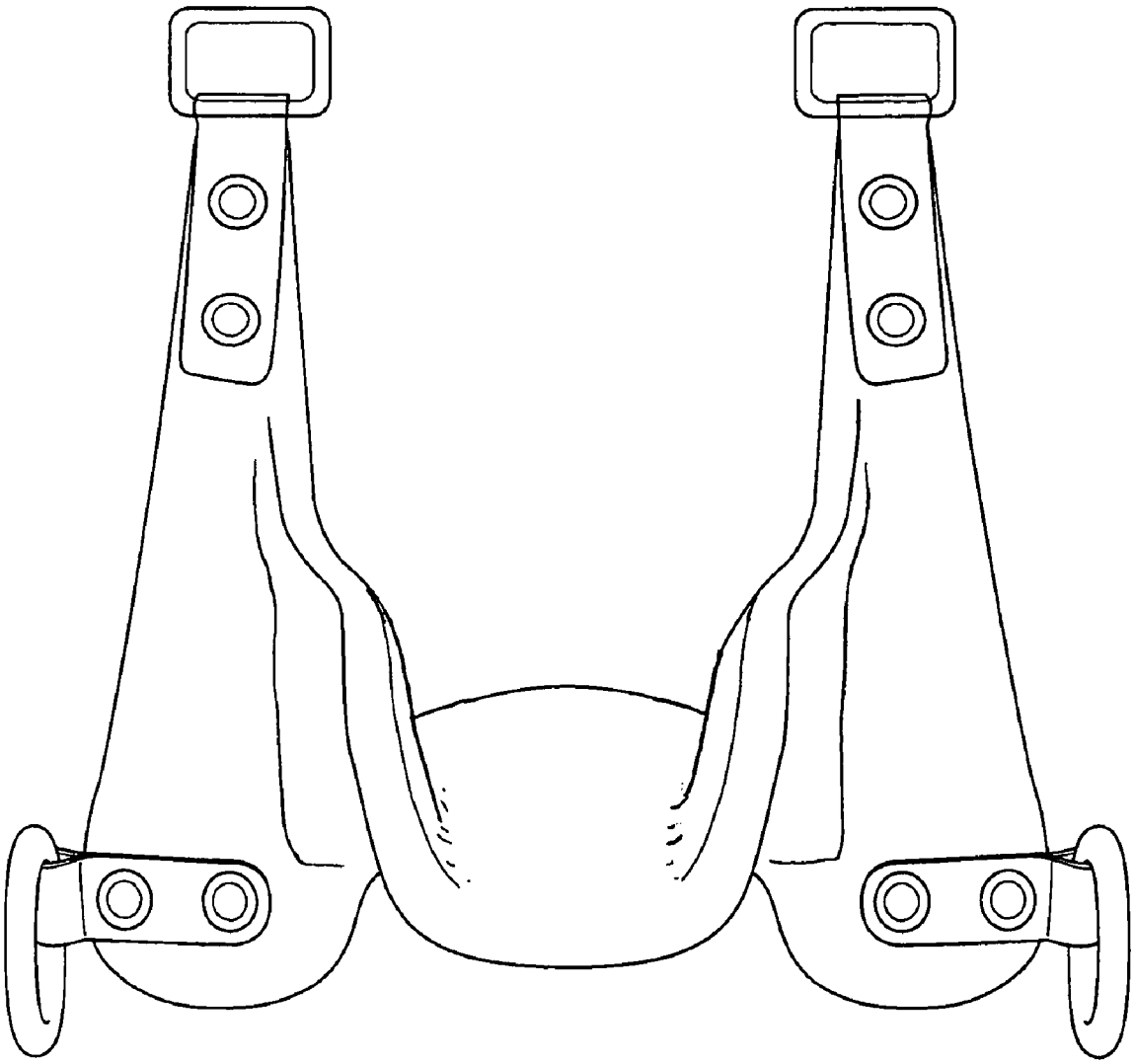
FIG. 6*e* is a far end view of the crupper of FIG. 6*a*, taken on arrow '6*e*'.
Figure 6F:
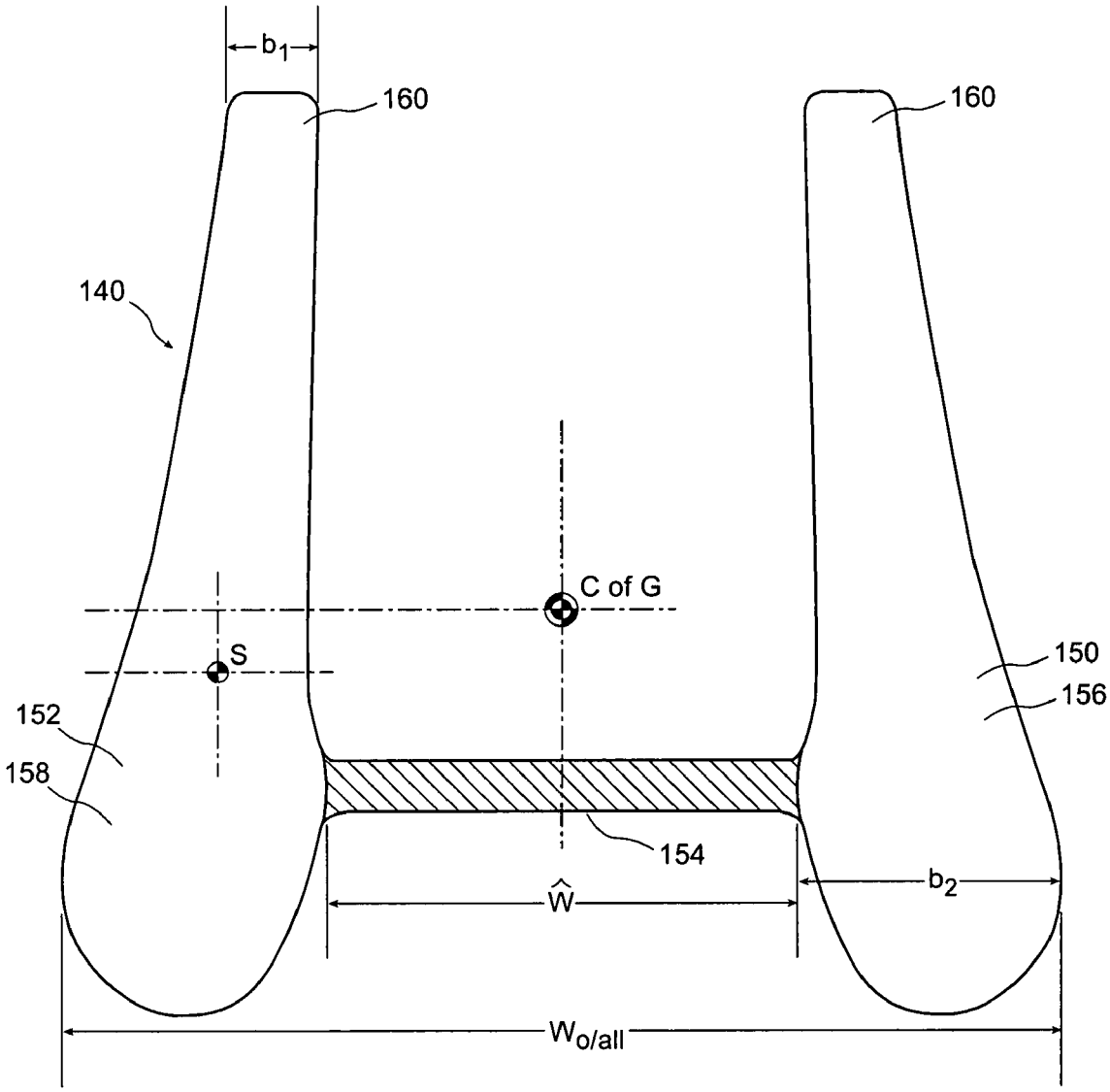
FIG. 6*f* is a view of the crupper of FIG. 6*a* analogous to FIG. 5*c*.

Taking a width across the base of the tongue, as indicated by the mean width w of the cross-section of FIG. 6*f*, the width of the lobes may be as great, or greater than w, such that the overall width of crupper 140 may be twice as great as w, or greater. It may also be that the width of each pad may increase, and may increase in a tapered, or continually widening, manner from a narrowest part or region having a width $b_1$ at the upper extremity of toe 160, to a widest part, having a greater width, $b_2$, at an altitude closer to the other end of pad 150, 152. That altitude of $b_2$, as seen in the constructed view of FIG. 6*f*, may be at a height lower than the CofG, may be lower than the centroid S of the pad, be it 150 or 152, and may, in general, lie abreast of, or somewhat lower than, web portion 154. This increase in width may be along a roughly linearly widening taper, and may tend to contribute to the lower region of pads 150, 152 being disproportionately heavy as compared, for example, to toes 160.

Although the embodiments illustrated and described above are preferred, the principles of the present invention are not limited to this specific example which is given by way of illustration. It is possible to make other embodiments that employ the principles of the invention and that fall within its spirit and scope as defined by the following claims.

I claim:

1. A computer comprising:

a base portion and a trough portion;

the base portion having a first surface for placement next to the hindquarters of an animal;

said trough portion being immovably joined to the base portion, the trough portion, in use, extending outwardly away from the animal;

said trough portion including a spoon;

said spoon extending inwardly proud of said first surface of said crupper a first distance;

said trough portion having a width abreast of said first surface; and said first distance having a magnitude in the range of 20 to 50% of said width of said trough portion.

2. The crupper of claim 1 wherein said crupper has a center of gravity, said first surface is formed on a compound curve, and a normal from said curve to said center of gravity has a length of less than 1½ inches.

3. The crupper of claim 1 wherein said crupper has a center of gravity, said first surface is formed on a compound curve; said spoon has an arcuate portion extending inwardly of said surface, said arcuate portion having an apex; a first normal constructed from said compound curve to said apex intersects said compound curve at a first location; a second normal constructed from said compound curve to said center of gravity intersects said compound curve at a second location; and said first location is separated from said second location by a distance of less than 1 inch.

4. The crupper of claim 1 wherein said crupper has a weight of at least 3 lbs., and a center of gravity located at least as close as 2 inches from said surface.

5. The crupper of claim 1 wherein said crupper has a weight of at least 4 lbs.

6. The crupper of claim 1 wherein said base of said crupper includes first and second wing portions bracketing said trough portion, said trough portion has a cross-sectional area defined abreast of said wing portions, each of said first and second wing portions having a surface area for placement facing the animal, and each of said surface areas of said wing portions being at least as great as said cross-sectional area of said trough portion.

7. The crupper of claim 1 wherein said base of said crupper includes first and second wing portions bracketing said trough portion, said trough has a span width abreast of said wing portions, and said wing portions have an overall span that is greater than 200% of said span width of said trough portion abreast of said wing portions.

8. The crupper of claim 1 wherein said base of said crupper includes first and second wing portions bracketing said trough portion, each of said first and second wing portions having a surface area for placement facing the animal, and each of said surface areas of said wing portions having a lobate portion on which an ellipse of maximum area is defined, said ellipse having an area of at least 7½ sq. in.

9. The crupper of claim 8 wherein a vertical-longitudinal plane bi-sects said trough portion, said ellipse has a splay angle from vertical, said ellipse having an major axis extending upwardly and outwardly relative to said vertical-longitudinal plane.

10. The crupper of claim 1 wherein said trough portion has a trough bottom and a center of gravity;

said trough bottom has a generally upwardly facing trough bottom surface;

said trough portion has a trough depth;

said center of gravity is located a normal distance from said trough bottom surface; said normal distance being less than one-half of said trough depth.

11. The crupper of claim 1 wherein said base portion has an overall surface area for placement facing the hindquarters of the animal, and that overall surface area exceeds 20 sq. in.

12. The crupper of claim 1 wherein said inwardly protruding portion of said spoon has a smooth arcuate edge free of crenellations.

13. A tail set crupper comprising:

a base portion and a trough portion;

the base portion having a surface for placement next to the hindquarters of an animal; outwardly away from the animal said trough portion including a spoon;

said spoon extending inwardly proud of said surface of said crupper; and said base of said crupper including first and second wing portions bracketing said trough portion, said crupper having a center of gravity;

said wing portions each having a chord extending from a lowermost extremity to an uppermost extremity;

said wing portions having an overall greatest span lying in a first plane perpendicular to said chord, said first plane meeting said chord at a first altitude;

a second plane extending through said center of gravity perpendicular to said chord intersects said chord at a second altitude;

said first altitude and said second altitude differing by an amount less than one inch.

14. The crupper of claim 13 wherein said amount is les than 10% of said chord length.

15. The crupper of claim 13 wherein said amount is less than ¼".

16. A tail set crupper comprising:

a base portion and a trough portion the base portion, having a surface for placement next to the hindquarters of an animal;

said trough portion being joined to the base portion, the trough portion, in use, extending outwardly away from the animal;

said trough portion including a spoon, said spoon extending inwardly proud of said surface; and said base portion of said crupper having a lower portion and an upper portion, and said lower portion having a greater through thickness than said upper portion.

17. The crupper of claim 16 wherein said base portion of said crupper tapers smoothly in thickness from said through thickness at said lower portion to said through thickness of said upper portion.

18. The crupper of claim 17 wherein said through thickness of said lower portion exceeds ½ inch.

* * * * *